US005402218A

United States Patent [19]

Miyashiro et al.

[11] Patent Number: 5,402,218

[45] Date of Patent: Mar. 28, 1995

[54] SYSTEM FOR REDUCING A SURFACE POTENTIAL OF AN IMAGE BEARING MEMBER IN AN IMAGE FORMING APPARATUS

[75] Inventors: Toshiaki Miyashiro, Ichikawa; Tatsuya Kobayashi, Soka; Tetsuya Kobayashi, Kawasaki, all of Japan

[73] Assignee: Canon Kabushiki Kaisha, Tokyo, Japan

[21] Appl. No.: 114,926

[22] Filed: Sep. 2, 1993

[30] Foreign Application Priority Data

Sep. 7, 1992 [JP] Japan ..... 4-262735

[51] Int. Cl.[6] ..... G03G 15/16

[52] U.S. Cl. ..... 355/274; 355/219

[58] Field of Search ..... 355/210, 214, 218, 219, 355/271, 274, 273, 276, 315; 361/225, 230

[56] References Cited

U.S. PATENT DOCUMENTS 3,970,381 7/1976 Meagher et al. ..... 355/315
5,034,777 7/1991 Ohzeki et al. ..... 355/274
5,132,738 7/1992 Nakamura et al. ..... 355/274
5,253,022 10/1993 Takeuchi et al. ..... 355/274

*Primary Examiner*—William J. Royer
*Attorney, Agent, or Firm*—Fitzpatrick, Cella, Harper & Scinto

[57] ABSTRACT

An image forming apparatus includes an image bearing member, a latent image forming device for forming a latent image having a high potential portion and a low potential portion before a toner image is formed on the image bearing member, a transfer material bearing member for bearing and for conveying a transfer material to a transfer station where the toner image on the image bearing member is transferred onto the transfer material, and a potential applying device for applying a predetermined potential which is lower than the potential of the high potential portion of a predetermined area of the image bearing member. According to the invention, when a portion of the transfer material bearing member is in the transfer station before transfer of the toner image has begun, a portion of the predetermined area is in the transfer station.

20 Claims, 9 Drawing Sheets

SYSTEM FOR REDUCING A SURFACE POTENTIAL OF AN IMAGE BEARING MEMBER IN AN IMAGE FORMING APPARATUS

BACKGROUND OF THE INVENTION

1. Field of the Invention

The present invention relates to an image forming apparatus such as a color printer, a color copying machine of electrophotographic type and the like.

2. Related Background Art

FIG. 9 shows a conventional color image forming apparatus. A primary charger 651, a plurality of developing devices 652, 653, 654 and 655 containing yellow developer, magenta developer, cyan developer and black developer, respectively, and a cleaner 656 are arranged around a conductive image bearing member 650.

Above the image bearing member 650, there is disposed an exposure means 657 comprising a laser, mirrors and the like. Below the image bearing member 650, there is disposed a transfer means 658. The transfer means 658 comprises a conductive drum body 659, an elastic member 660 made of urethane foam, silicone rubber foam or the like and covering the drum body, and a flexible sheet 661 made of polyethylene terephtalate, polyurethane or the like and covering the elastic member. A gripper 662 for holding a transfer material is provided on the transfer drum. Sheet-shaped transfer materials 664 are stacked in a sheet supply cassette 663.

Around the transfer means 658, there are arranged an adsorb roller 665 for electrostatically absorbing the transfer material 664 to the flexible sheet 661, and a separating charger 666 for separating the transfer material 664 from the flexible sheet 661. The reference numeral 668 denotes a fixing device. Incidentally, the drum body 659 is connected to a transfer charging high voltage source (not shown).

Explaining an image forming process of the above-mentioned color image forming apparatus, first of all, a first color electrostatic latent image formed on the image bearing member 650 by exposing image light A corresponding to a first color image signal from the exposure means 657 on the image bearing member is visualized by the developing device 652 containing the yellow developer, for example.

On the other hand, the supplied transfer material 664 is pinched between the transfer means (transfer material bearing member) 658 and the absorb roller 665 by the absorb roller 665 which can be abutted against and separated from the transfer means 658. At the same time, the absorb and transfer bias is applied to the drum body 659 and the absorb roller 665, with the result that the charge is created to hold the transfer material 664 on the transfer means 658 by the electrostatical absorbing force. Then, the transfer material 664 is conveyed to a transfer station (nip B between the image bearing member 650 and the transfer means), where the first color visualized image formed on the image bearing member 650 is transferred onto the transfer material.

Thereafter, the residual developer remaining on the image bearing member 650 is removed by the cleaner 656, and then, a new electrostatic latent image is formed on the image bearing member 650 by the exposure means 657 in response to a second color image signal. This electrostatic latent image is developed by the developing device 653 containing the magenta developer, for example, thereby forming a visualized image. This second color visualized image is transferred onto the transfer material to which the first color visualized image has already been transferred. Similarly, a third color (cyan) visualized image and a fourth color (black) visualized image are successively formed on the image bearing member 650 by using the cyan developer and the black developer, respectively. These visualized images are successively transferred onto the same transfer material 664 in a superimposed fashion in the same manner as the second color visualized image.

After the transferring operations are finished, the charge on the transfer material 664 is removed by the separating charger 666 to remove the electrostatic absorbing force between the transfer material and the transfer means 658, and then the transfer material is separated from the transfer means by a separating pawl 669. Then, the transfer material 664 is sent to the fixing device 668, where the superimposed images are permanently fixed to the transfer material. When the second color visualized image is transferred, a value of the transfer bias is changed to correct the potential drop after the transferring of the first color visualized image. 0f course, such correction is effected when the third and fourth visualized images are transferred.

By the way, the transfer means 658 of the aforementioned color image forming apparatus is opposed to the image bearing member 650 with a small gap (about 100 μm) or with an appropriate nip. 0n the other hand, during the formation of the image, the image bearing member 650 is charged with the predetermined potential (for example, −600 Volts) by the primary charger 651.

When the electrostatic latent image is not formed on the image bearing member 650, for example, during the pre-rotation of the image bearing member before the latent image is formed or after the visualized image was formed, the image bearing member 650 charged with the potential having the highest absolute value is contacted with the transfer means 658. Consequently, due to the difference in potential between the image bearing member 650 and the transfer means 658, the charges on the surface of the image bearing member 650 are transferred onto the surface of the transfer means 658. Particularly in an image forming apparatus utilizing the reverse image, since the polarity of the primary charge, the polarity of the developer and the polarity of the absorbing bias are the same, the surface of the transfer means 658 is charged to the polarity repelling the developer, by the chargers transferred from the image bearing member 650. As a result, the transfer electric field is weakened by the charge repelling the developer, so that the potential difference sufficient to effect the good transferring and the good absorption cannot be established between the transfer means 658 and the image bearing member 650 and between the transfer means and the absorb roller 665, thereby causing the poor transferring and poor absorpiton.

To eliminate the above problem, it is considered to increase the values of the transfer bias and the absorbing bias by amounts corresponding to the increased charge of the transfer means 658 by the charges transferred from tile image bearing member 650. However, if the value of the transfer bias is increasd to cancel the charge amount transferred from the image bearing member 650, it is feared that the transfer bias exceeds the endurance limit of the flexible sheet 661, thereby creating the pinhole in the flexible sheet, 661. To avoid this, if a thickness of the flexible sheet 661 is increased, since the electrostatic capacity of the transfer means 658 as the thickness of the flexible sheet 661 is increased, the further high transfer bias is required to obtain the effective transfer current.

Further, since the resistance of the flexible sheet 661 is varied from the insulation zone to the intermediate resistance zone in accordance with the environmental condition, under the high temperature and high humidity condition, the increased potential is decreased to some extent during the rotation of the transfer means. However, under the low temperature and low humidity condition, the increased potential is not substantially decreased. Thus, the increasing value of the transfer bias for cancelling the charge transferred from the image bearing member must be changed in accordance with the environmental conditions, with the result that any temperature detection sensor and humidity detection sensor must be provided, which leads to the increase of the number of parts, thereby making the apparatus large-sized and expensive.

SUMMARY OF THE INVENTION

An object of the present invention is to provide an image forming apparatus which can prevent the poor transferring caused by the difference in potential between an image bearing member and a transfer material bearing means during the non-transferring of an image.

Another object of the present invention is to provide an image forming apparatus which can prevent the poor absorption caused by the difference in potential between an image bearing member and a transfer material bearing means during the non-transferring of an image.

A further object of the present invention is to provide an image forming apparatus which can prevent the charge having the same polarity as the transfer charge from applying from an image bearing member to a surface of a transfer material bearing means during the non-transferring of an image.

A still further object of the present invention is to provide an image forming apparatus which can effect the good transferring to form a good image.

The other objects and features of the present invention will be apparent from the following explanation referring to the accompanying drawings.

DETAILED DESCRIPTION OF THE PREFERRED EMBODIMENTS

The present invention will now be explained in connection with embodiments thereof with reference to the accompanying drawings.

Figure 1:
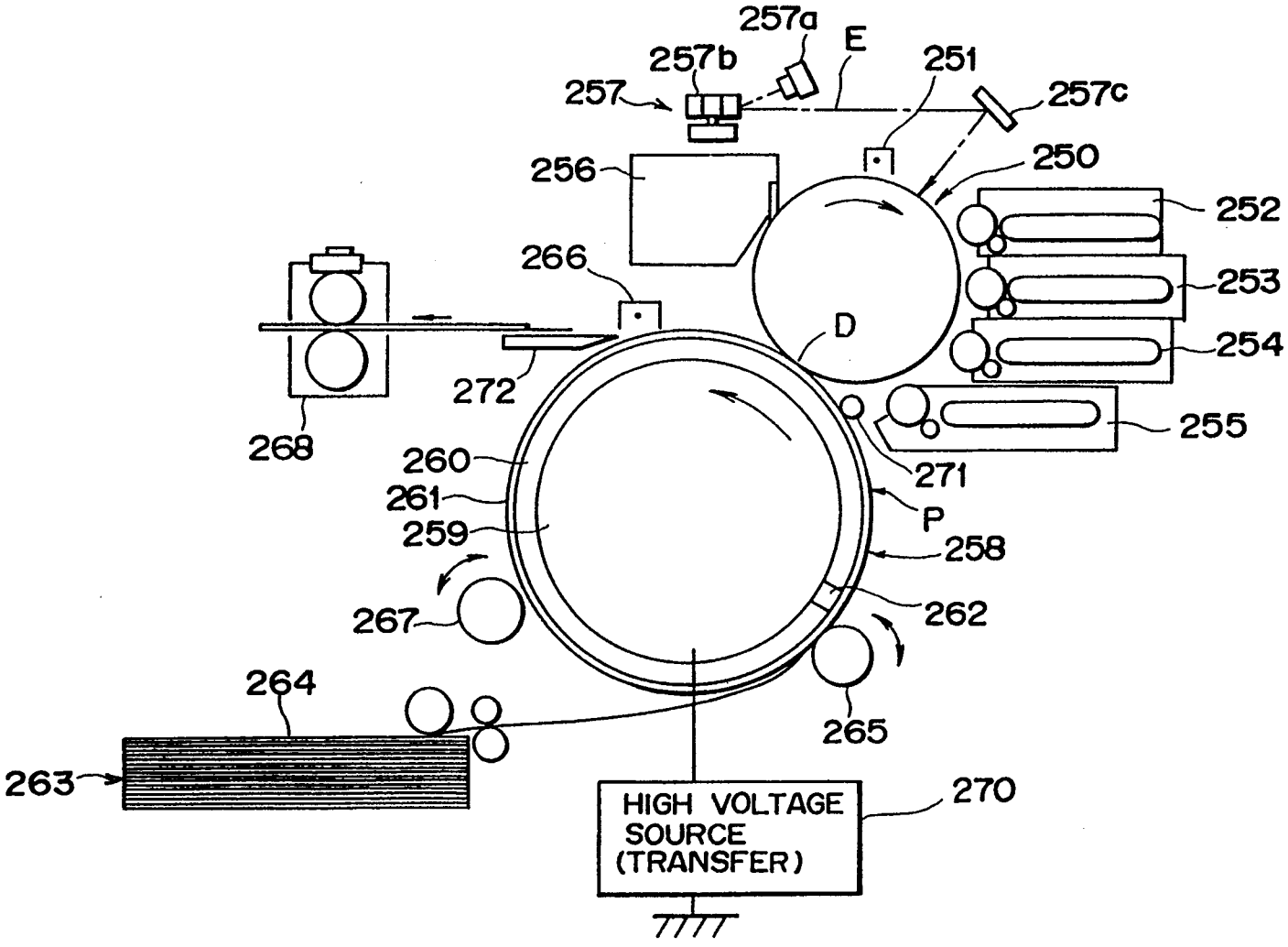
FIG. 1 is a schematic sectional constructural view of an image forming apparatus according to a first embodiment of the present invention.

FIG. 1 shows a color electrophotographic printer as a color image forming apparatus according to a first embodiment of the present invention. Around an image bearing member 250, there are arranged a primary charger 251, a plurality of developing devices 252, 253, 254 and 255 containing yellow developer, magenta developer, cyan developer and black developer, respectively, and a cleaner 256.

In the illustrated embodiment, the image bearing member 250 comprises an organic photo-conductive layer having the negatively charged polarity, and a conductive substrate made of aluminium which is earthed and which supports the organic photo-conductive layer.

An exposure means 257 comprising a laser 257*a*, mirrors 257*b*, 257*c* and the like is disposed above the image bearing member 250. A transfer means 258 is disposed below the image bearing member 250. The transfer means (transfer material bearing means) 258 comprises a conductive drum body 259, an elastic member 260 made of urethane foam, silicone rubber foam or the like and convering the drum body, and a dielectric flexible sheet 261 made of polyethylene terephtalate, polyurethane or the like and covering the elastic member. A gripper 262 for holding a transfer material (transfer member) is provided on the transfer means. Sheet-shaped transfer materials 264 are stacked in a sheet supply cassette 263. Incidentally, a peripheral length of the transfer means 258 is greater than a peripheral length of the image bearing member 250 just by two times.

Around the transfer means 258, there are arranged an adsorb roller 265 for electrostatically absorbing the transfer material 264 to the flexible sheet 261, a separating charger 266 for separating the transfer material 264 from the flexible sheet 261, and a current remove (charge remove) charger 267 for effecting the current removal to initialize the flexible sheet 261. The reference numeral 268 denotes a fixing device. Incidentally, the conductive drum body 259 is connected to a transfer charging high-voltage source 270. The reference numeral 272 denotes a separating paw.

The transfer means 258 of the aforementioned color image forming apparatus is opposed to the image bearing member 250 with a small gap (about 100 $\mu$m) or with an appropriate nip.

A second exposure device (exposure means) 271 for uniformly exposing the image bearing member 250 along its longitudinal direction is disposed immediately upstream of an image transfer station D (where the image bearing member 250 is opposed to the transfer means 258) in a moving direction of the image bearing member. The second exposure means 271 may include a fluorescent lamp or an LED array.

Explaining an image forming process of the abovementioned color image forming apparatus, first of all, a first color electrostatic latent image formed on the image bearing member 250 by exposing image light E corresponding to a first color image signal from the exposure means 257 on the image bearing member is visualized by the developing device 252 containing the yellow developer, for example. In the illustrated embodiment, since the image forming apparatus is of reverse development type, the charging polarity of the primary charger 251 is the same as the charging polarity of each developer (toner). Further, the charging polarity of the primary charger 251 is opposite to the charging polarity of the transfer charging power source 270.

On the other hand., the supplied transfer material 264 is pinched between the transfer means 258 and the absorb roller 265 by the absorb roller 265 which can be abutted against and separated from the transfer means 258. At the same time, the absorb and transfer bias is applied to the drum body 259 and the absorb roller 265, with the result that the charge is created to hold the transfer material 264 on the transfer means 258 by the electrostatical absorbing force. The voltage applied to the absorb roller 265 has the same polarity as the charging polarity of the primary charger 251 and opposite to the charging polarity of the transfer voltage. Then, the transfer material 264 is conveyed to the transfer station (nip between the image bearing member 250 and the transfer means), where the first color visualized image formed on the image bearing member 250 is transferred onto the transfer material.

Thereafter, the residual developer remaining on the image bearing member 250 is removed by the cleaner 256, and then, a new electrostatic latent image is formed on the image bearing member 250 by the exposure means 257 in response to a second color image signal. This electrostatic latent image is developed by the developing device 253 containing the magenta developer corresponding to the second color image signal, for example, thereby forming a visualized image. This second color visualized image is transferred onto the transfer material to which the first color visualized image has already been transferred. Similarly, a third color (cyan) visualized image and a fourth color (black) visualized image are successively formed on the image bearing member 250 by using the cyan developer and the black developer, respectively. These visualized images are successively transferred onto the same transfer material 264 in a superimposed fashion in the same manner as the second color visualized image. After the transferring operations are finished, the charge on the transfer material 254 is removed by the current remove charger 267 to disappear the electrostatic absorbing force between the transfer material and the transfer means 258, and then the transfer material is separated from the transfer means 258 by the separating pawl 272. Then, the transfer material 264 is sent to the fixing device 268, where the superimposed four color toner images are mixed and fused, thereby fixing as a permanent full-color image. During the above process, when the second color visualized image is transferred, a value of the transfer bias is changed to correct the potential dropped after the transferring of the first color visualized image. Of course, such correction is effected when the third and fourth visualized images are transferred. Now, the transfer bias applied to the drum body 259 may be increased for each color.

On the other hand, during the formation of the image, the image bearing member 250 is charged with the predetermined potential (for example, −600 Volts) by the primary charger 251. That is to say, the high potential portion of the electrostatic latent image formed after the image exposure is −600 Volts. The low potential portion of the electrostatic latent image which is reduced by the image exposure is −100 Volts.

When the electrostatic latent image is not formed on the image bearing member 250, for example, during the pre-rotation of the image bearing member before the latent image is formed or after the visualized image-was formed, the image bearing member 250 charged with the potential having the highest absolute value is contacted with the transfer means 258.

Figure 2:
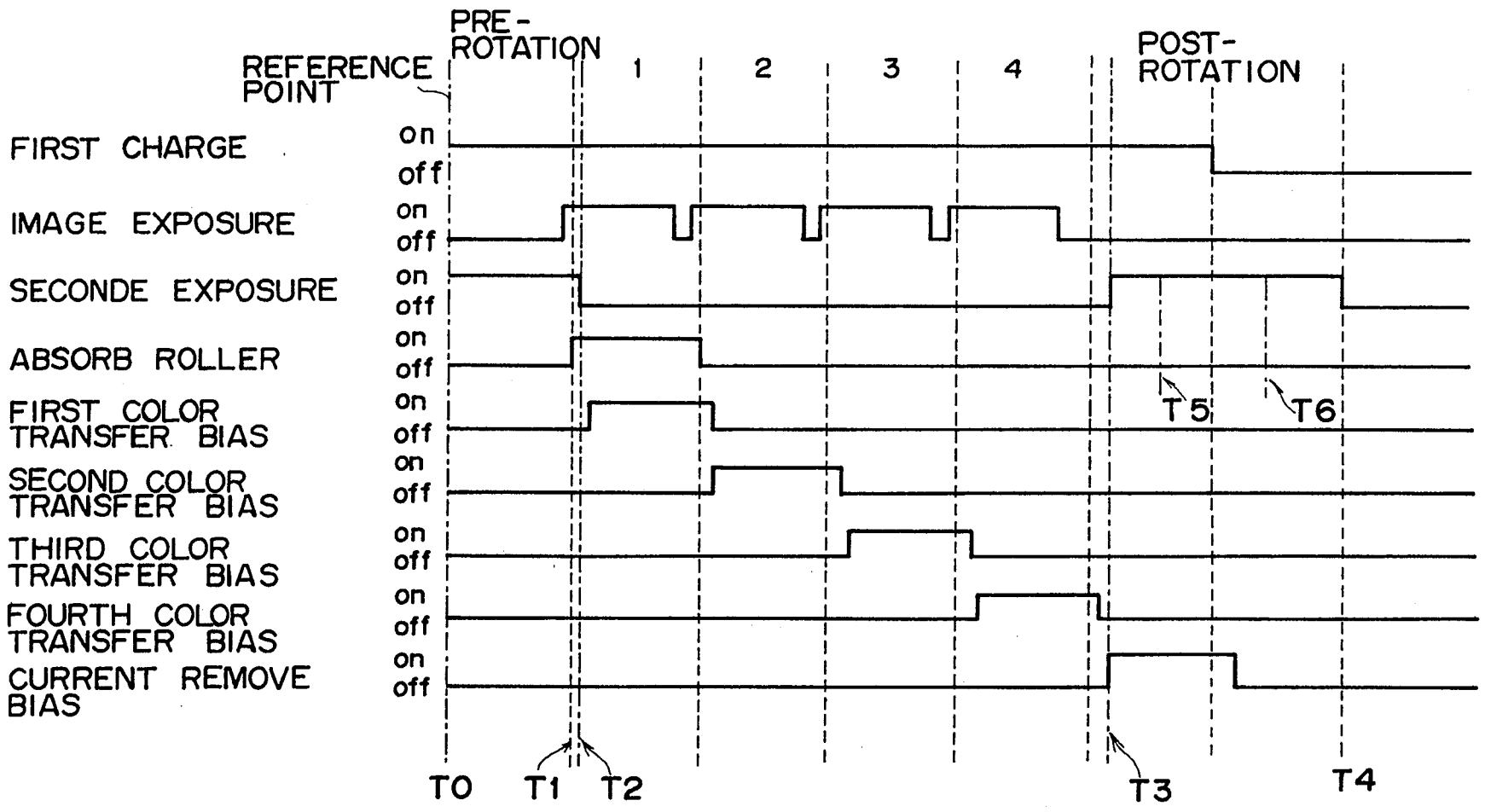
FIG. 2 is a timing chart showing an image forming process of the apparatus of FIG. 1.

FIG. 2 shows an image forming sequence of the image forming apparatus of the present invention, wherein a position where the absorb roller 265 is opposed to the transfer means 258 is used as a reference point.

In FIG. 2, from a building-up or rising-up time T0 to a time T1, a pre-rotation is effected as a preparation stage for the image formation. In this case, the first charge bias is applied to the primary charger 251 from the predetermined high voltage source to stabilize the corona current and the high voltage source outputting such corona current. Accordingly, if the image bearing member 250 so charged is contacted with the transfer means 258 as it is, the above-mentioned problem will occur. However, in the present invention, as seen from FIG. 2, till a time T2, a portion immediately upstream of the image transfer station D (where the image bearing member 250 is opposed to the transfer means 258) is light-illuminated by the second exposure device 271. Therefore, the surface potential on the image bearing member 250 is abruptly reduced immediately in front of the image transfer station D. From the test, it was found that the surface potential of the image bearing member 250 after the second exposure was −100 Volts or less and the potential of the transfer means 258 contacted with the image bearing member 250 at the image transfer station D was not changed before and after such contact.

The time T2 is delayed from the time T1 because, at the time (T1) when the transfer material 264 starts to be held by the transfer means 258, a portion of the transfer means 258 situated at the image transfer station D is positioned at a downstream side (in the moving direction of the transfer means 258) of a point P where a trailing end of the transfer material 264 is held (a distance between the absorb position of the absorb roller and the upstream point P corresponds to the maximum length of the transfer material ).

Now, if the second exposure device 271 is turned OFF at the time (T1) when the absorption of the absorb roller is started, a zone of the transfer means 258 from the transfer station D to the point P will be subjected to the minus charge from the image bearing member 250 directly at the time point T1. The poor transferring occurs in this minus-charged zone, notwithstanding such zone on which the transfer material 264 is then carried is then plus-charged by the plus charge applied to the back surface of the flexible sheet 261 from the high voltage source 270. Further, the minus-charged zone causes the poor absorption during the absorption is effected by the absorb roller 265.

Accordingly, the second exposure effected by the second exposure device 271 must continue at least until the portion P of the transfer means 258 on which the trailing end of the longest transfer material is to be carried or born before the transferring of the image passes through the transfer station D. Even when the portion of the image bearing member which is contacted with the transfer material is charged by the primary charger, the second exposure must be started before a leading end of the transfer material 264 is positioned to the transfer station D for the first color transferring by a time corresponding to one revolution of the transfer means 258. However, in order to stabilize the first charge (primary charge), as shown in FIG. 2, it is preferable to start the primary charge as early as possible, and the second exposure process must be started at least before the primary-charged zone of the image bearing member 250 enters into the image transfer station D.

As mentioned above, while the explanation regarding the pre-rotation is made, it is desirable that the similar countermeasure is effected during the post-rotation after t-he image formation. That is to say, after the last color image has been transferred to the transfer material 264, the charge on the transfer means 258 is removed by the current remove charger 267. During this charge removal, if the portion of the transfer means which has been charge-removed is contacted with the image bearing member 250, the transfer means 258 will be charged to remain the charge on the transfer means. Thus, it is preferable that the image bearing member 250 is charged by the second exposure device during the post-rotation. Preferably, a time period that such second exposure is effected is at least from a time point T5 when the charge-removal zone of the transfer means 258 enters into the image transfer station D to a time point T6 when the primary-charged zone of the image bearing member 250 enters into the image transfer station D. In FIG. 2, the second exposure is continued from the time point T3 when the charge removal by the current remove charger 267 is started to the time point T4 when the post-rotation is finished. Of course, the re-start of the second exposure is effected after the laser color image has been transferred onto the transfer material at the image transfer station D. Incidentally, even when a transfer material 264 having a different length is used, there is no problem so long as the second exposure is effected immediately after the point P on the transfer means 258 has just passed through the image transfer station D during the transferring of the last color image.

Figure 3:
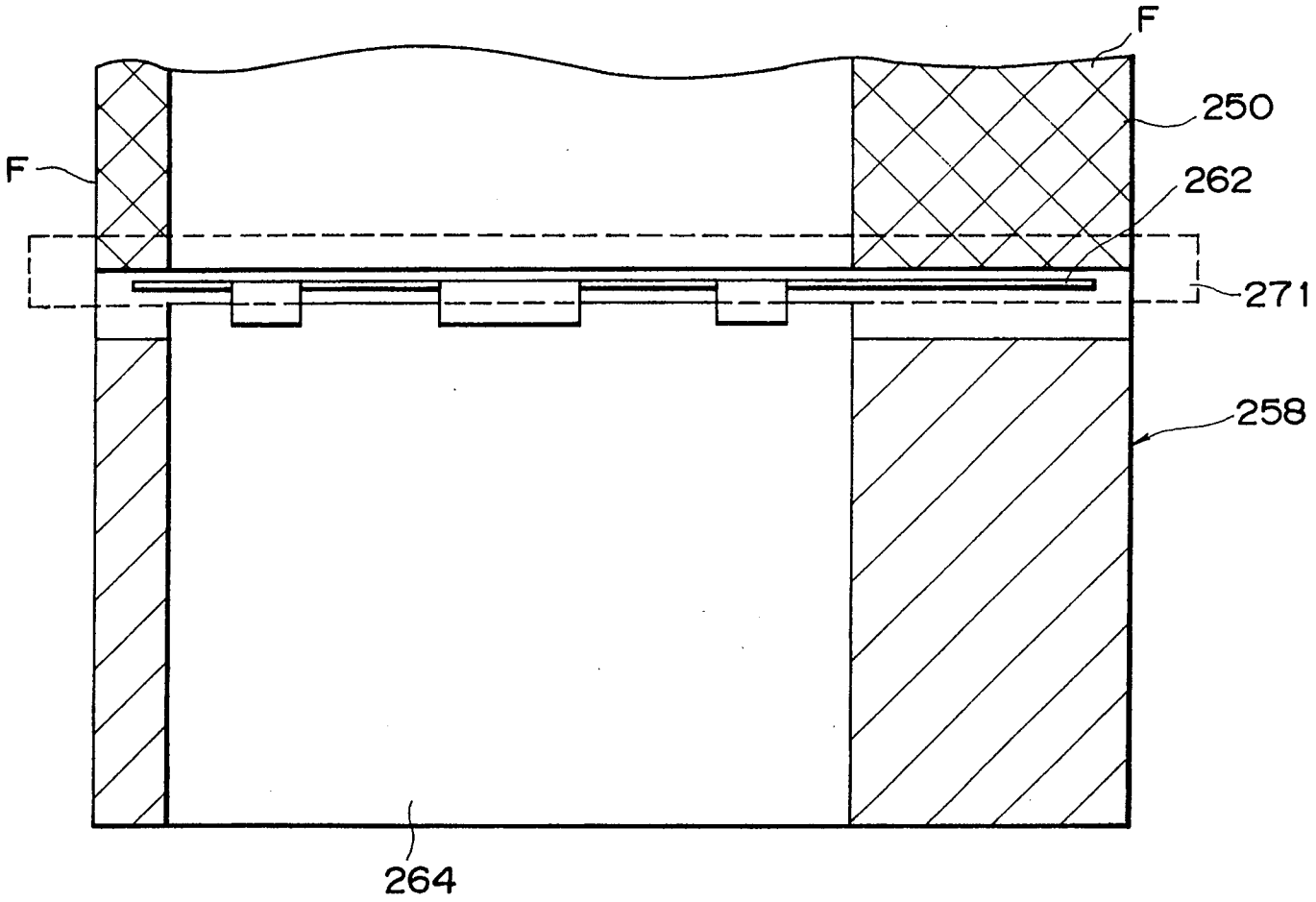
FIG. 3 is a view showing a contacting portion between an image bearing member and a transfer means of FIG. 1.

Further, when the LED array is used as the second exposure device 271, as shown in FIG. 3, if only 10 a portion F of the transfer means 258 on which the transfer material is not held in the generatrix direction of the transfer means is exposed by the second exposure means 271 during the transferring operation, the difference in surface potential between the image bearing member 250 and the transfer means 258 at this portion F is decreased to reduce the amount of the charge shifting at this portion F, with the result that it is possible to reduce the current of the transfer bias source.

Figure 4:
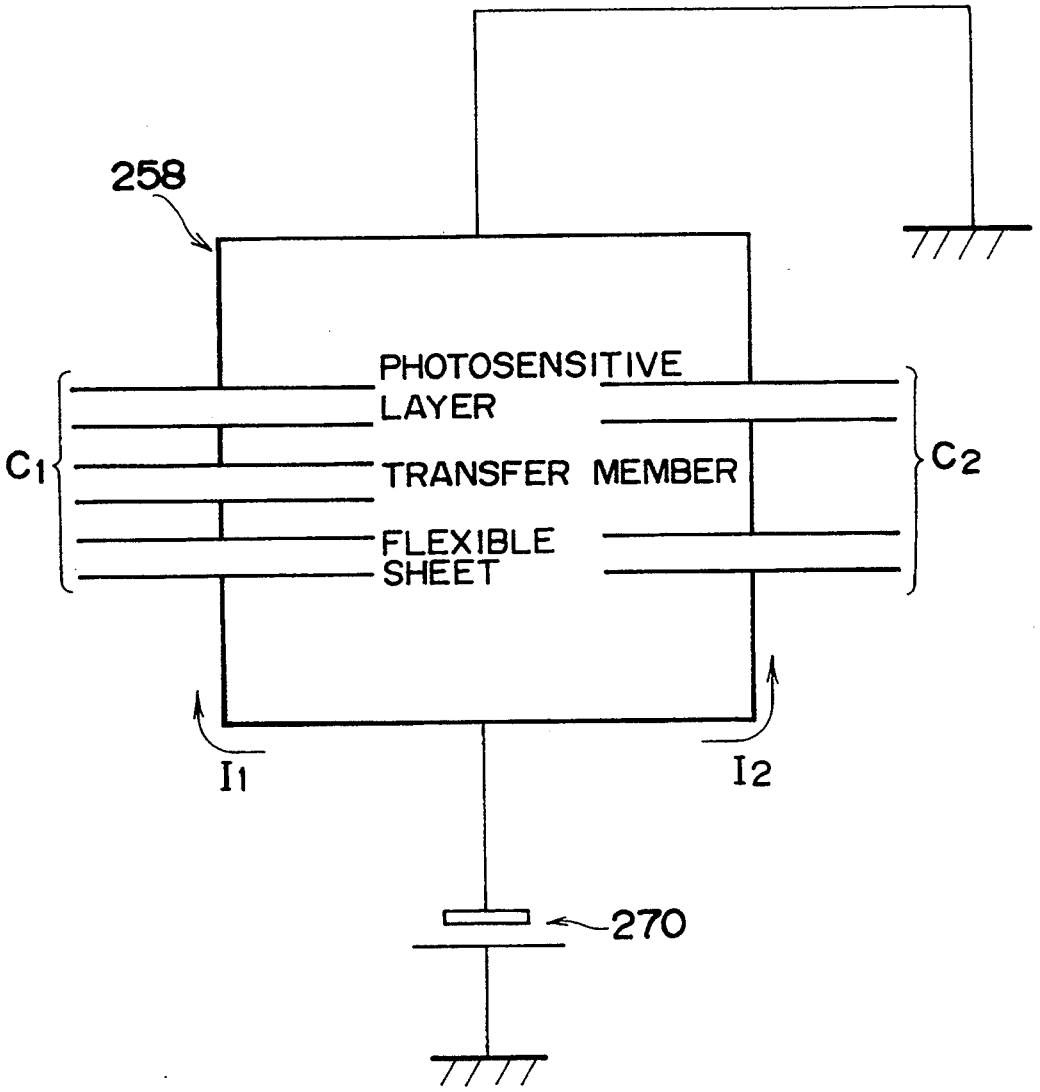
FIG. 4 is a modelling view of the image bearing member and the transfer means of FIG. 1.

Next, the transfer means 258 and the image bearing member 250 will be explained with reference to FIG. 4 which shows a modelling view of these elements. In FIG. 4, regarding capacities $C_1$, $C_2$ of two capacitors, the capacity $C_2$ (per unit area) becomes greater since it does not include the transfer material 264. Thus, if these capacitors are charged with the same bias (transfer bias), the transfer current $I_1$ will be sometimes unstable depending upon the area of the portion F on the transfer means 258. To avoid this, in the illustrated embodiment, the size of the transfer material 264 is detected at the sheet supply portion and the like and the portion F is exposed by the second exposure device accordingly so that a current $I_2$ is decreased, thereby stabilizing the transfer current $I_1$. Consequently, it is not required to increase the transfer bias in order to stabilize the transfer current $I_1$, thereby preventing the pinhole from generating in the flexible sheet.

Incidentally, in the above example, while the LED array was used, an AC corona discharger may be used to remove the current.

Figure 5:
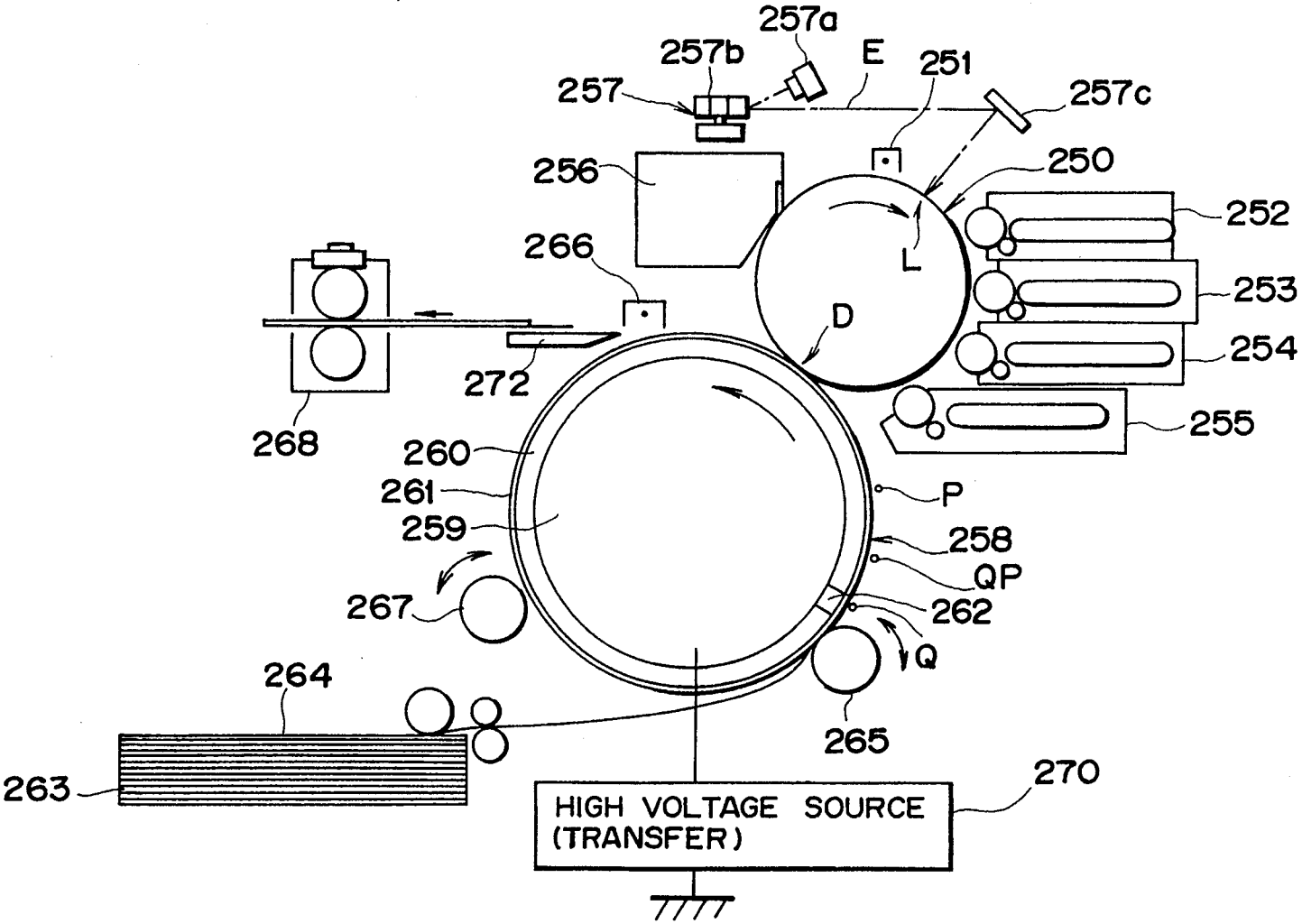
FIG. 5 is a schematic sectional constructural view of an image forming apparatus according to a second embodiment of the present invention.
Figure 6:
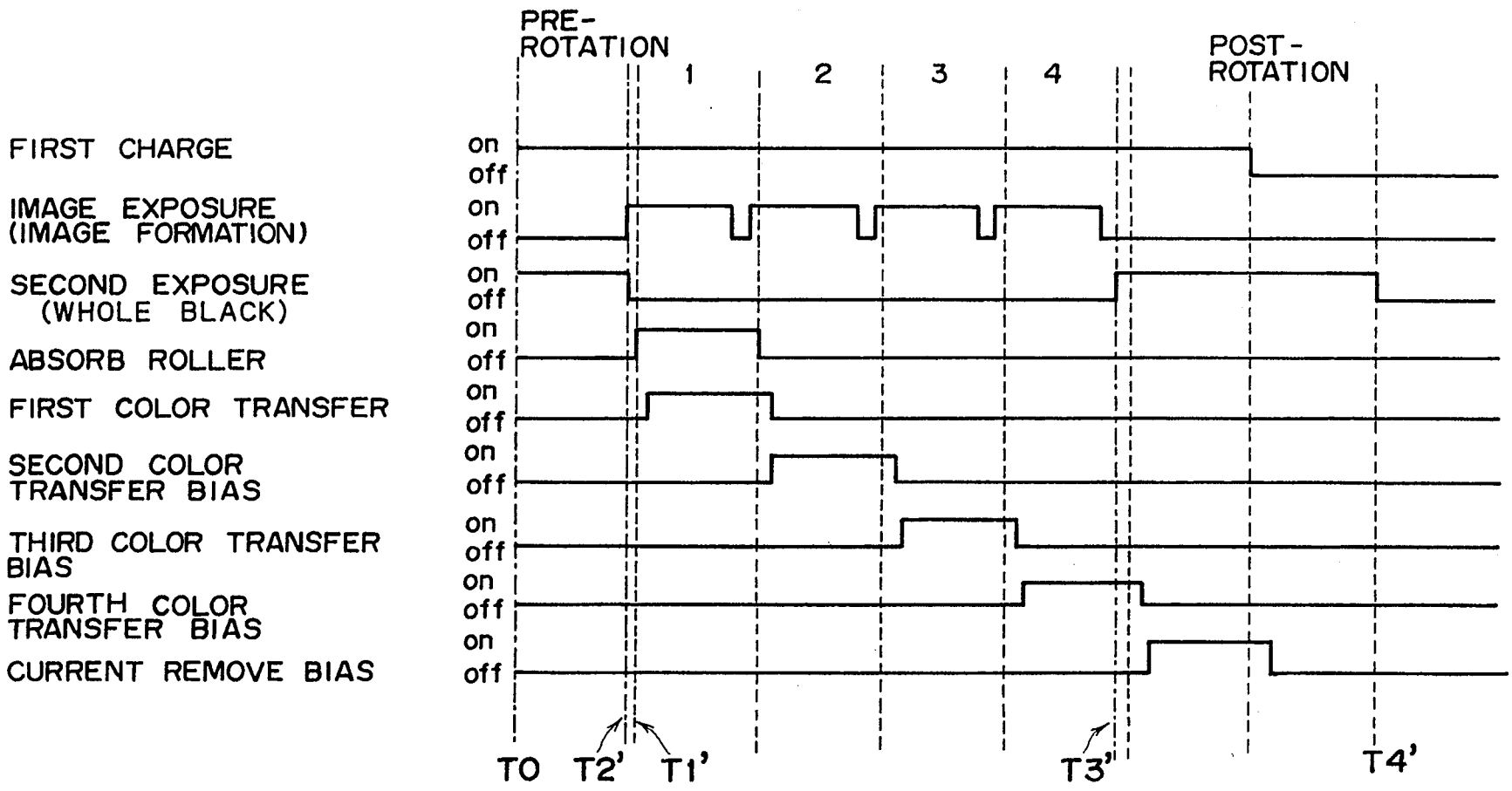
FIG. 6 is a timing chart showing an image forming process of the apparatus of FIG. 5.

FIG. 5 shows an image forming apparatus according to a second embodiment of the present invention, and Fig. 6 shows an operation sequence of this apparatus.

In this embodiment, the image exposure means 257 acts as a means for reducing the potential of the image bearing member. In this example, a laser 257*a* is operated from the building-up time (T0) to a time T2′ (conventionally, the laser was not operated up to the time T2′). In this case, the light signal is a signal for forming an electrostatic latent image corresponding to a so-called whole black image (i.e., for exposing the whole longitudinal area of the image bearing member 250).

Thus, the surface potential of the image bearing member 250 is decreased as in the previous embodiment, thereby preventing the charge from shifting or transferring to the transfers means 258. Of course, it should be noted that the whole black image signal is emitted until the exposure means 257 emits the light signal-corresponding to the image to be formed at a predetermined timing. Further, in FIG. 6, although the start of the second exposure is effected simultaneously with the start of the first exposure, the second exposure may be effected when the first-charged area of the image bearing member 250 reaches to exposure position L.

Further, as in the aforementioned embodiment, although the second exposure by the exposure device 257 is effected also during the post-rotation, after the charge removal by the current remove device 267 is started, when the charge remove start position of the transfer means 258 (any point QP between the point P at which the trailing end of the transfer material 264 is held by the transfer means 258 and a point Q at which the leading end of the transfer material 264 is held by the transfer means) reaches to the image transfer station D, the surface potential on the image bearing member 250 at the zone thereof exceeding a point (not shown; but a point on the image bearing member corresponding to the point QP) opposing to the transfer means at the image transfer station D may be decreased, and, thus, at least a zone downstream of this point on the image bearing member 250 may be previously exposed by the second exposure.

By the way, in the illustrated embodiment, since the potential of the image bearing member 250 is decreased to the whole black (bright potential) during both the pre-rotation and the post-rotation, the negatively charged developer from the developing devices 252 to 255 arranged in a confronting relation to the image bearing member 250 is apt to scatter.

Particularly, in case of a developing device containing one-component magnetic developer in which a main attraction force for holding the developer depends upon only the Coulomb's force of the charge for holding the developer, since the developer is flying toward the image bearing member 250 and is sent to the transfer means 258 by the rotation of the image bearing member 250, it is feared that the transfer means 258 and accordingly the back surface of the transfer material are smudged by the developer. To avoid this, it is desirable to apply the bias (about 500 to 1000 Volts) to the developer to prevent the developer from flying during the whole black exposure process.

Further, when a means for preventing the mixing the color developers between color developing devices as described in the Japanese Patent Application No. 2-158468 is used, since the developer is not born on a developer bearing member during the whole black exposure process, a further effective result can be obtained. Further, in case of a developing device of non-contact type, the above-mentioned toner scattering preventing method is effective, but, in case of a developing device of contact type, a color mixing preventing means wherein the developing device is separated from the image bearing member may be used. Furthermore, in an image forming apparatus utilizing a transfer material cleaner (not shown) for cleaning a transfer means by a fur brush, as well as the above-mentioned countermeasure is adopted, if the transfer material is cleaned, it is possible to prevent the disadvantage caused by using this embodiment further effectively.

As mentioned above, according to this embodiment, since the image exposure means 257 also serves to reduce the surface potential of the image bearing member 250, the apparatus can be more simplified. Further, the disadvantage caused by using this embodiment can be eliminated by using the conventional color mixing preventing means.

Figure 7:
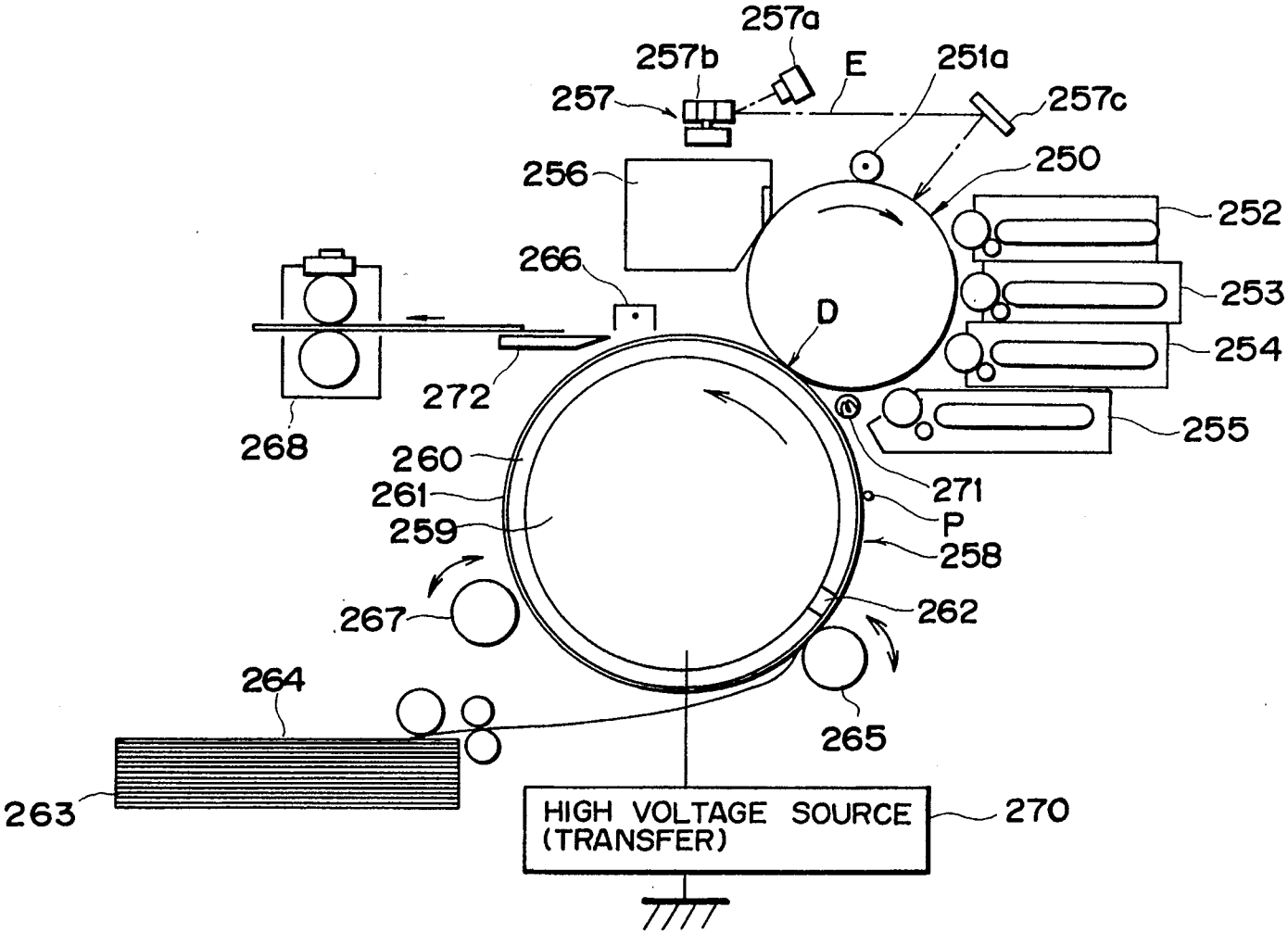
FIG. 7 is a schematic sectional constructural view of an image forming apparatus according to a third embodiment of the present invention.

FIG. 7 shows an image forming apparatus according to a third embodiment of the present invention. In this embodiment, in place of the corona charger, a roller charger 251*a* contacting with the image bearing member 250 is used as a primary charger. In comparison with the corona charger, the roller charger 251*a* has a feature that, when the first charge bias is applied to the charger (for example, when the charge of −600 Volts is desired, the bias obtained by overlapping DC −600 V with Ac about 2000 Vp-p (peak-to-peak voltage) may be applied to the charger), the desired surface potential of an object can contained.

Therefore, when the roller charger is used, it may not be operated from the pre-rotation to stabilize the surface potential of the image bearing member 250. Thus, in the image forming apparatus utilizing the roller charger 251*a*,by using as image forming sequence as shown in FIG. 8, it is possible to make the potential on the image bearing member 250 to an extent that does not afford the inconvenience to the transfer means 258, without positively exposing the image bearing member 250.

Figure 8:
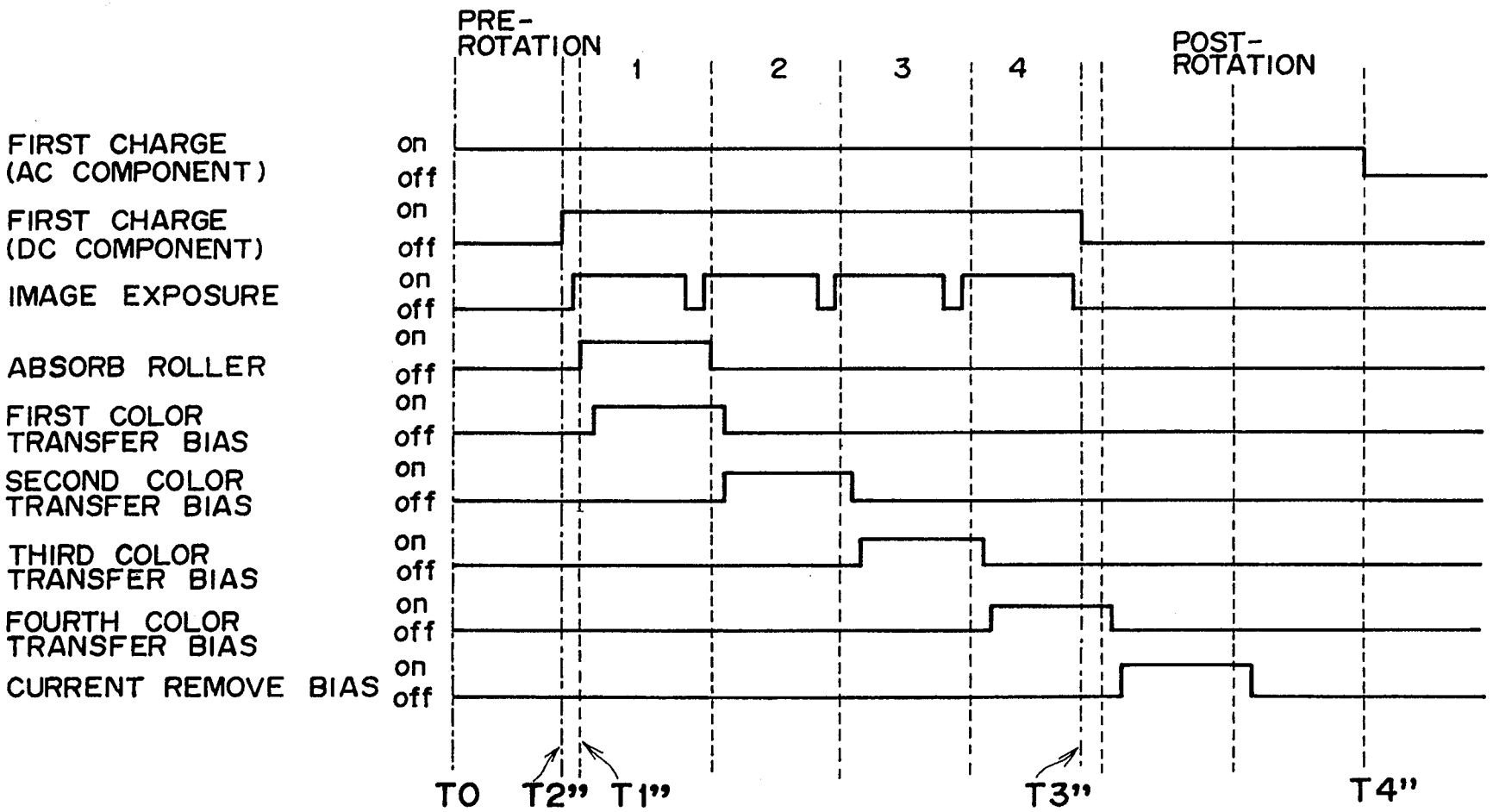
FIG. 8 is a timing chart showing an image forming process of the apparatus of FIG. 7.
Figure 9:
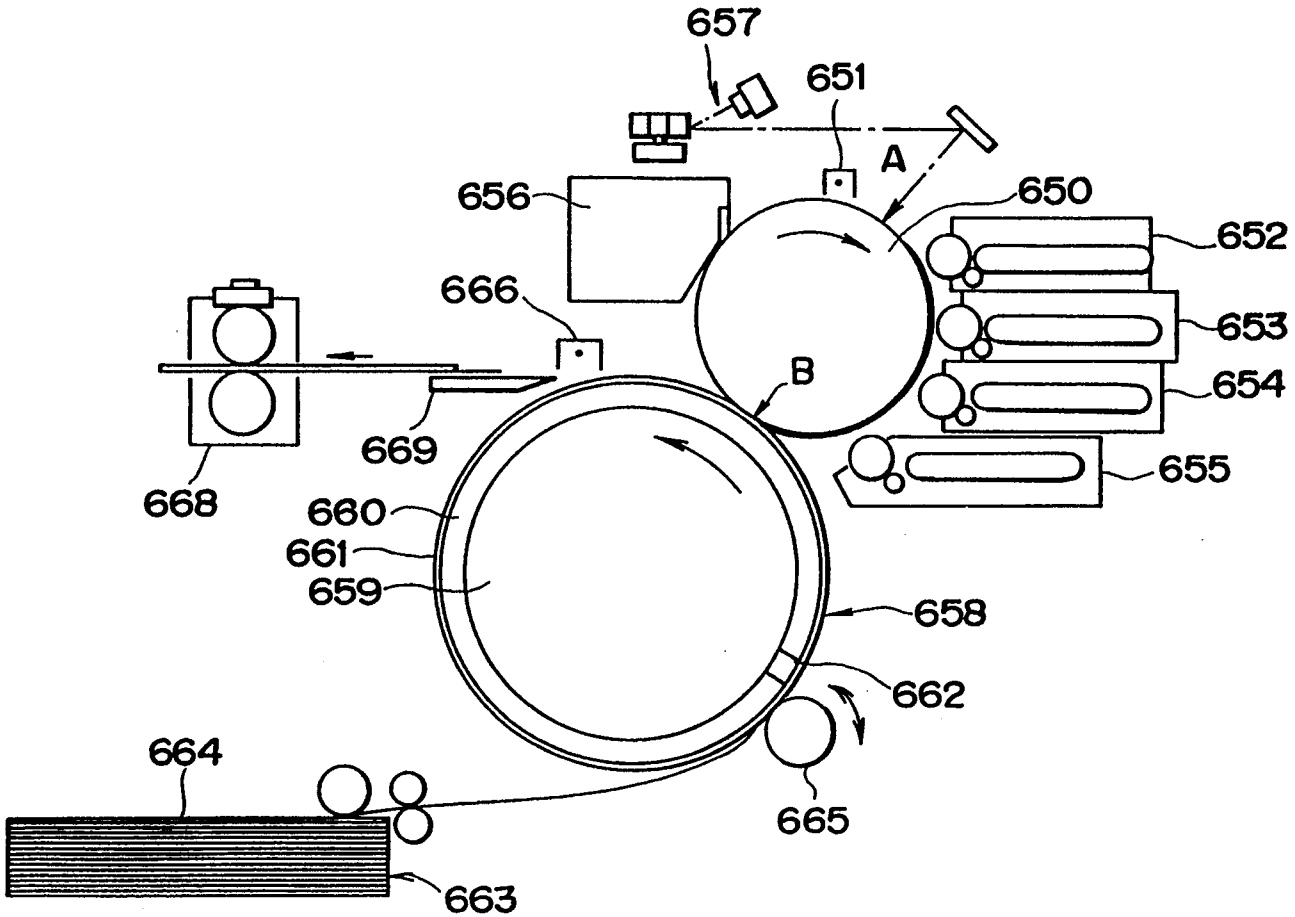
FIG. 9 PRIOR ART
FIG. 9 is a schematic sectional constructural view of a conventional image forming apparatus.

Explaining in more detail, in FIG. 8, DC component of the bias of the roller charger 251*a* is 0 Volts from the building-up time (T0) to a time T2″. Thus, up to this time T2″, the surface potential on the image bearing member 250 is substantially zero (0) (thus, the surface potential is substantially the same as the DC component), with the result that there is substantially no potential difference between the surface of the transfer means 258 and the surface of the image bearing member 250. Further, at the time point T2″, the DC component of the first charge bias is changed to the potential (about −600 Volts) suitable to the image formation. Thus, after the time T2″, the normal latent image formation can be effected. The time T2″ corresponds to a time immediately before the point (not shown) on the image bearing member 250 opposing to the point Q on the transfer means 258 as in the aforementioned embodiment passes through the roller charger 251*a*. In other words, the first-charged portion of the image bearing member 250 corresponds to a tip end of the electrostatic latent image written on the image bearing member 250 in a sub-scan direction of the latent image.

While the explanation was made regarding the pre-rotation, as in the aforementioned embodiment, it should be noted that the DC component of the first charge bias is changed in the post-rotation. In this case, a timing time point T3″ that the DC component of the first charge bias is changed is any time point between the time point when the last latent image of the latent images corresponding to the image to be formed on the longest transfer material 264 is formed and the time point immediately before the above-mentioned point on the image bearing member 250 enters into roller charger 251*a*. Further, also in this embodiment, although there arises a problem regarding the scattering of the developer as in the previous embodiment, by using the same countermeasure as mentioned above, it is apparent that such problem can be solved.

As mentioned above, according to this embodiment, since the roller charger is used, it is possible to reduce the surface potential of the image bearing member 250 without exposure, thereby reducing the light-fatigue of the image bearing member 250 due to the excessive exposure more than the aforementioned embodiment. Of course, since the roller charger is used, the output voltage of the first charge bias source can be lowered, thereby reducing the cost of the high voltage circuit. Further, it should be noted that there is no problem regarding the ozone which would be generated by the corona charger.

What is claimed is:

1. An image forming apparatus, comprising:

an image bearing member;

latent image forming means for forming a latent image having a high potential portion and a low potential portion on said image bearing member;

toner image forming means for forming a toner image on the image bearing member in accordance with the formed latent image;

transfer material bearing member for bearing and conveying a transfer material to a transfer station where the toner image on said image bearing member is transferred onto the transfer material; and potential applying means for applying a predetermined potential which is lower than the potential of said high potential portion to a predetermined area of said image bearing member;

wherein when a portion of said transfer material bearing member not bearing the transfer material is in the transfer station before the transferring of the toner image is started, at least a portion of said predetermined area is in said transfer station.

2. An image forming apparatus according to claim 1, wherein said transfer material bearing member is arranged in contact with said image bearing member.

3. An image forming apparatus according to claim 1, wherein said potential applying means is a first discharge member for discharging said image bearing member to said predetermined potential.

4. An image forming apparatus according to claim 3, wherein said first discharge member charges said image bearing member to form the latent image.

5. An image forming apparatus according to claim 4, wherein said first discharge member is capable of contacting with said image bearing member, so that different potentials are applied to said first discharge member between when said image bearing member is discharged and when said image bearing member is charged to form the latent image.

6. An image forming apparatus according to claim 3, wherein said image bearing member is a photosensitive layer, and said first discharge member exposes said photosensitive layer.

7. An image forming apparatus according to claim 6, wherein said first discharge member exposes said photosensitive layer to form the latent image in response to image information.

8. An image forming apparatus according to claim 3, further comprising a second discharge member for discharging said transfer material bearing member, and wherein, when a discharged area of said transfer material bearing member discharged by said second discharge member is in said transfer station after the transferring of the toner image, a portion of said predetermined area is in said transfer station.

9. An image forming apparatus according to claim 1, wherein said latent image forming means has charger means for charging said image bearing member, and the potential application by said potential applying means is started before a portion of said image bearing member charged by said charger means reaches to a potential applying position where the potential is applied by said potential applying means.

10. An image forming apparatus according to claim 1, wherein said predetermined potential is lower than 100 Volts.

11. An image forming apparatus according to claim 1, wherein, regardless of a size of the transfer material born by said transfer material bearing member, when a maximum transfer material bearing portion not bearing the transfer material is in said transfer station before the transferring of the toner image is started, at least a portion of said predetermined area is in said transfer station.

12. An image forming apparatus according to claim 1, wherein said transfer material bearing member has a bearing sheet for bearing the transfer material, to a back surface of which a transfer charge bias is applied during the transferring of the toner image.

13. An image forming apparatus according to claim 12, wherein said transfer material bearing member has an electrode disposed behind said bearing sheet and provided on the whole surface of said transfer material bearing member, to which the transfer charge bias is applied.

14. An image forming apparatus according to claim 13, wherein the charging polarity of said high potential portion is opposite to the polarity of said transfer charge bias.

15. An image forming apparatus according to claim 13, further comprising an absorb member provided at a transfer material bearing side of said transfer material bearing member to electrostatically absorb the transfer material to said transfer material bearing member, wherein the polarity of the charge applied to the transfer material by said absorb member is the same as the charging polarity of said high potential portion.

16. An image forming apparatus according to claim 12, wherein the charging polarity of said high potential portion is opposite to the polarity of said transfer charge bias.

17. An image forming apparatus according to claim 16, further comprising an absorb member provided at a transfer material bearing side of said transfer material bearing member to electrostatically absorb the transfer material to said transfer material bearing member, wherein the polarity of the charge applied to the transfer material by said absorb member is the same as the charging polarity of said high potential portion.

18. An image forming apparatus according to claim 12, further comprising an absorb member provided at a transfer material bearing side of said transfer material bearing member to electrostatically absorb the transfer material to said transfer material bearing member, wherein the polarity of the charge applied to the transfer material by said absorb member is the same as the charging polarity of said high potential portion.

19. An image forming apparatus according to claim 1, wherein a plurality of color toner images are transferred onto the transfer material born by said transfer material bearing member in a superimposed fashion.

20. An image forming apparatus according to claim 19, wherein a full-color toner image can be formed on the transfer material.

* * * * *